US006149706A

United States Patent [19]

Shimizu et al.

[11] Patent Number: 6,149,706

[45] Date of Patent: Nov. 21, 2000

[54] NORROSION RESISTANT SINTERED BODY HAVING EXCELLENT DUCTILITY, SENSOR RING USING THE SAME, AND ENGAGEMENT PART USING THE SAME

[75] Inventors: Takayoshi Shimizu, Ichinomiya; Tetsuya Kondoh, Nagoya, both of Japan

[73] Assignees: Daido Tokushuko Kabushiki Kaisha, Aichi; Sumitomo Electric Industries, Ltd., Osaka, both of Japan

[21] Appl. No.: 09/204,145

[22] Filed: Dec. 3, 1998

[30] Foreign Application Priority Data

| | | | |
|---|---|---|---|
| Dec. 5, 1997 | [JP] | Japan | 9-352261 |
| Aug. 6, 1998 | [JP] | Japan | 10-223420 |
| Oct. 15, 1998 | [JP] | Japan | 10-294263 |
| Oct. 16, 1998 | [JP] | Japan | 10-295291 |

[51] Int. Cl.[7] ..... B22F 5/00

[52] U.S. Cl. ..... 75/246; 75/244

[58] Field of Search ..... 75/244, 246; 419/12

[56] References Cited

U.S. PATENT DOCUMENTS

| | | | |
|---|---|---|---|
| 3,980,444 | 9/1976 | Reen . | |
| 4,618,473 | 10/1986 | Jandeska, Jr. | 419/11 |
| 4,891,080 | 1/1990 | Del Corso et al. | 148/326 |

FOREIGN PATENT DOCUMENTS

| | | |
|---|---|---|
| 2 596 067 | 9/1987 | France . |
| 07228954 | 8/1995 | Japan . |
| WO 93/18195 | 9/1993 | WIPO . |

*Primary Examiner*—Ngoclan Mai
*Attorney, Agent, or Firm*—Bacon & Thomas, PLLC

[57] ABSTRACT

A corrosion resistant sintered body having excellent ductility is provided by sintering, at temperatures of not less than 1050 to less than 1300° C., powders which are composed by adding metal compound of B to and mixing with powders of ferrite stainless steel containing C≦0.1 wt %, Si≦3.0 wt %, Mn≦0.30 wt %, Ni≦2.0%, 11 wt %≦Cr≦22 wt %, Mo≦3.0%, and the rest being substantially Fe, at an amount of B in the mixed powders being between more than 0.03 wt % and less than 0.2 wt % based on the weight of the powder.

20 Claims, 13 Drawing Sheets

(6 of 13 Drawing Sheet(s) Filed in Color)

P434L - CrB NO ADDED (B = 0%)

P444L - CrB NO ADDED (B = 0%)

P434L - CrB 0.25% (B = 0.041%)

P444L - CrB 0.25% (B = 0.041%)

P434L - CrB 0.50% (B = 0.083%)

P444L - CrB 0.50% (B = 0.083%)

P434L - CrB 0.75% (B = 0.124%)

P444L - CrB 0.75% (B = 0.124%)

P434L - CrB 1.00% (B = 0.165%)

P444L - CrB 1.00% (B = 0.165%)

P434L - CrB 1.25% (B = 0.205%)

P444L - CrB 1.25% (B = 0.205%)

NORROSION RESISTANT SINTERED BODY HAVING EXCELLENT DUCTILITY, SENSOR RING USING THE SAME, AND ENGAGEMENT PART USING THE SAME

BACKGROUND OF THE INVENTION

1. Field of the Invention

The invention relates to a corrosion resistant sintered body having excellent ductility, specifically, relates to a sintered body having excellent ductility capable of maintaining a high elongation and a parts such as a sensor ring using the sintered body.

2. Description of the Related Art

Conventionally, a sensor ring which issues pulses having frequencies in proportion to rotation number of wheels in an anti-lock system of vehicle breaking system, has been used. The sensor ring is shaped as a whole in a ring having many gear like concave and convex in all outer circumference for causing the sensor ring to issue pulse signals of frequency in proportion to said wheel rotation number via an electromagnetic pick-up disposed in the vicinity of said gear like concave and convex.

The sensor ring has a complicated configuration in the whole. If it is composed in an ingot, processing costs are made expensive. As a result, conventionally, the sensor ring is composed of a powder sintered body.

As materials for this kind of sensor ring, powders of ferrite stainless steels have conventionally been employed.

However, the sensor ring composed of the sintered body of the ferrite stainless powders may cause cracks in company with corrosion.

The sensor ring is served to engage with an shaft of an opposite matter. When the shaft of the opposite matter is expanded in diameter by corrosion, the elongation of the sensor ring could not follow this expansion and it is the possibility to cause cracks.

For solving such problems, there is a method of heightening the density of the sensor ring by sintering liquid phases. However, this has not been reduced to practice because sizes are considerably varied in the sensor ring requiring high precision.

In the above description, we have explained about the sensor ring. However, these problems also become problems to practically use mechanism parts, particularly, parts used in conditions that it is fitted to or engaged with an opposite part.

SUMMARY OF THE INVENTION

It is an object of the present invention to provide a corrosion resistant sintered body of less deterioration of elongation after corrosion, and suitable for a sensor ring and the other engagement parts to be used to anti-lock system of vehicle breaks and the like.

A corrosion resistant sintered body having excellent ductility, obtained by the process comprising the steps of: sintering a powder at a sintering temperature from not less than 1050° C. to less than 1300° C.; wherein said powder comprising a ferrite stainless steel powder containing 11 to 22 wt % of Cr and a metal compound of B, the amount of B being from not less than 0.03 to less than 0.2 wt % based on the weight of said powder.

A corrosion resistant sintered body having excellent ductility obtaining by a process comprising the step of sintering a ferrite stainless steel powder containing 11 to 22% of Cr and metal compound of B, the amount of B being from not less than 0.03 to less than 0.2 wt % based on the weight of said powder; wherein pores of said sintered body is rounded and the number of open pores which open to air is small.

BRIEF DESCRIPTION OF THE DRAWINGS

The file of this patent contains at least one drawing executed in color. Copies of this patent with color drawings will be provided by the U.S. Patent and Trademark Office upon request and payment of the necessary fee.

In the accompanying drawings.

DETAILED DESCRIPTION OF THE PRESENT INVENTION

Figure 1:
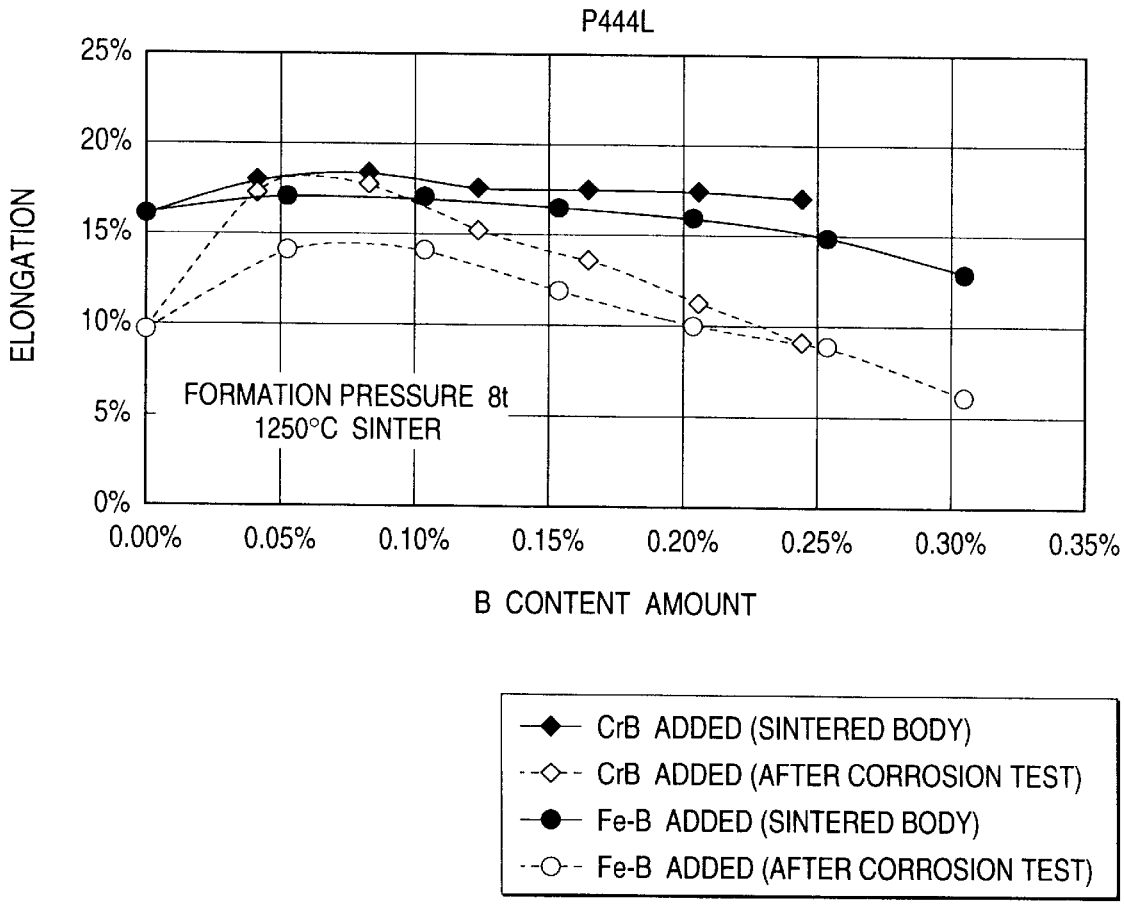
FIG. 1 is a view showing the elongation characteristics of the sintered bodies composed of mixed powders where CrB and Fe—B were added to the P444L powders.

Detailed description of the present invention will be described as follows referring to the accompanying drawing.

A first corrosion resistant sintered body having excellent ductility according to the present invention, is obtained by sintering a powder at a temperature from not less than 1050° C. to less than 1300° C. The powder is composed of a powder comprising a ferrite stainless steel powder containing 11 to 22 wt % of Cr and a metal compound of B, the amount of B being from not less than 0.03 to less than 0.2 wt % based on the weight of said powder.

The ferrite stainless steel powders may contains: C:≦0.1 wt %; Si:≦3.0 wt %; Mn:≦0.30 wt %; Ni:≦2.0 wt %; Cr: 11 to 22 wt %; Mo:≦3.0 wt %; and the rest being substantially Fe. Further, the metal compound of B is preferably Cr compound.

A second corrosion resistant sintered body having excellent ductility according to the present invention is obtained by sintering a ferrite stainless steel powder containing 11 to 22% of Cr and metal compound of B, the amount of B being from not less than 0.03 to less than 0.2 wt % based on the total weight of the powder. In this case, pores of said sintered body is rounded and the number of pores opening to air is small.

The second corrosion resistant sintered body having excellent ductility contains C:≦0.1 wt %; Si:≦3.0 wt %; Mn:≦0.30 wt %; Ni:≦2.0 wt %; and Mo:≦3.0 wt %.

In the second corrosion resistant sintered body, the metal compound of B preferably contains Cr.

In the second corrosion resistant sintered body, the volume ratio of open pores which opens to air to the whole of pores are preferably not more than 20%.

A sensor ring according to the present invention uses the first and second corrosion resistant body as described above.

An engagement part according to the present invention uses the first and second corrosion resistant body as described above.

The first corrosion resistant sintered body is produced by sintering, at a temperature of not less than 1050 to less than 1300° C., powders which are composed by adding metal compound of B to and mixing with powders of ferrite stainless steel.

In this way, the corrosion resistance of the sintered body is enhanced, and at the same time the elongation after corrosion is maintained at high levels. It is, therefore, confirmed that when the sensor ring is composed with such sintered body, the sensor ring can be prevented from cracking after corrosion, but it is not clear about a detailed reason at present why high elongation is maintained by adding and mixing the metal compound of B.

However, the following points are assumed.

The present inventors made studies on micro structures of the sintered bodies employing the powders. When comparing with micro structures of sintered bodies without adding B compound, the following facts were found.

Namely, it is found that, in the products with addition of B compound, shapes of pores were comparatively round, and each of them was small. On the other hand, in the products without addition of B, shapes of pores were long and narrow (at portions of maximum diameter) and an each end of them was sharp.

The difference of shapes of respective pores are is considered that in the products with the addition of B compound, liquid phases are partially and easily formed by reactions between B in the B compound and a matrix in a sintering course. The sintering is progresses under the existence of the liquid phase, and on the other hand, in the products with no addition of B compound, the liquid phase is difficult to occur.

For the liquid phases to usefully occur, it is necessary to add and mix B in the form of the metal compound.

Actually, if B is solely contained as a powder element (alloying component of powder itself), a good result is not obtained. This is assumed that B is too much uniformly dispersed in each of powders. Consequently, the liquid phase by reaction of B and the matrix does not effectively occur. Incidentally, a melting point of B sole is high as 2300° C. and B solely is never melted when sintering.

In contrast, when B is added and mixed in the form of the metal compound, there appear parts where B partially much exist, and this is assumed that the formation of the liquid phase by the reaction between the matrix and B is accelerated.

When the B compound is added according to the invention, the sintered body also maintains the high elongation even after corrosion. This is assumed that in view of pores in small and round shapes, cracks are difficult to occur as starting points of pores in relation with external force and decrement of continuous pores and open pores (pores open to air) as mentioned later.

The inventors confirmed that the sintered bodies with and without the B compound were not so much different in the sintered density.

In general, when the density of the sintered body becomes high, the corrosion resistance is improved. However, although the density itself is not remarkably changed (not become high), the corrosion resistance itself of the sintered body added with the B compound according to the invention is improved.

When the inventors observed the micro structure of the sintered body, it was confirmed that open pores were lessened and continuous pores were decreased in the surface layer of the sintered body together with the shapes of pores becoming small and round by addition of the B compound.

This fact is assumed to be a reason why the corrosion resistance is enhanced though the sintered density is not heightened so much by addition of the B compound.

Namely, it is considered the following facts. When the B compound is added in accordance with the invention, although the sintering does not advance to an extent that the sintered density is remarkably heightened, the sintering is accelerated to an extent that shapes of pore are changed and to an extent that open pores are lessened in the outer layer. Further, the continuous pores are considerably decreased in comparison with no addition of the B compound. Therefore, the corrosion resistance and the elongation after corrosion are effectively improved.

The present inventors observed the condition of pores by enlarging (for example, 400 times) an optional section of the powder sintered body including the surface layer of the powder sintered body to which B compound is added. The outer shape of the pores is round, and the ratio of continuous pores (open pores) which opens at the surface layer in the sintered body is remarkably small in comparison with that of the continuous pores of the sintered body to which B compound is not added.

It is considered that this fact largely contributes to the corrosion resistance and the elongation after corrosion.

Here, in the present invention, the volume ratio of the open pore (continuous pore ratio) is preferably not more than 20%, more preferably not more than 14%, while it depend on the additional amount of B compound and the producing process after the addition.

Accordingly, it is possible to further enhance the air tightness of the surface layer of the sintered body. When the sintered body is used for the sensor ring and the engagement part, it is possible to further improve the corrosion resistance.

The shape of the pores are controlled to be round. Accordingly, the ductility is enhanced when the sintered body is used for the sensor ring and the engagement part. Therefore, it is possible to resist the load from the outside.

Here, as the engagement part, there is a part used for a portion which is fitted to the other part and needs the corrosion resistance (particularly, preservation), such as a metal bush, a fastener, and a chemical device part.

In the sintered body of the invention, the content amount of Cr in the ferrite stainless steel is in the range of 11 to 22%.

A reason for defining 11% or more of Cr is as the following facts. If Cr is less than 11%, the corrosion resistance of the ferrite stainless steel itself is insufficient. It is difficult to sufficiently heighten the corrosion resistance, though the B compound is added.

Reversibly, if Cr is more than 22%, the hardness of the sintered body becomes high and decreases the elongation. Therefore, it is difficult to make large the elongation after corrosion, though the B compound is added. Further, since the corrosion resistance is inherently high, in spite of the addition of the B compound, the corrosion resistance itself is not largely improved. Thus, the addition of the B compound is not meaningful so much.

In the invention, the B compound is calculated in term of B content and is added not less than 0.03% to less than 0.20%.

If B is less than 0.03%, the effect by adding the B compound is scarcely provided. On the other hand, if it is contained more than 0.20%, the elongation after corrosion is equivalent to or less than no addition of the B compound. Similarly, the addition thereof is meaningless.

The corrosion resistant sintered body is obtained by sintering the powders at the temperatures between not less than 1050° C. and less than 1300° C. In the thus obtained sintered body, the above mentioned effect can be exhibited.

That is, at a temperature of less than 1050° C., the sintering does not progress preferably. On the contrary, at a temperature of more than 1300° C., very much amount of the liquid phase occurs, and the size precision is made unstable by large changing of the sintered density. As a result, such a product is not suitable for manufacturing of precise sintered parts in the sensor ring or the like. More preferable are products obtained by sintering at the temperature between 1150° C. and 1250° C.

It is preferable in the invention to employ powders of said ferrite stainless steel containing in weight percent C:≦0.1%, Si:≦3.0%, Mn:≦0.30%, Ni:≦2.0%, Cr: 11 to 22%, Mo:≦3.0% and the rest being Fe.

As addition embodiments of B, it may be added and mixed in forms of CrB, $CrB_2$ or Fe—B, and in particular, it is confirmed that the addition of CrB may bring about more preferable results.

The corrosion resistance sintered body according to claim 1 to ■is applied to various engagement parts, particularly, the sensor ring, thereby obtaining the good practical characteristic as described later.

The limiting reasons of the chemical elements in the invention will be discussed in detail.

C:≦0.1%, (preferably C:≦0.030%)

If C is contained not less than 0.1%, the powders are hardened, and the Green density is lowered. Since deterioration of the corrosion resistance is remarkable, C is limited to be not more than 0.1%. A preferable content is not more than 0.030%.

Si:≦3.0% (preferably Si:≦1.50%)

If being not less than 3.0%, the powders are considerably hardened, the Green density is lowered, and the compactability is worsened. Accordingly, Si is limited to be not more than 3.0%. A preferable content of Si is not more than 1.50%.

Mn:≦0.30% (preferably, ≦0.20%)

If Mn is not less than 0.30%, oxygen in the powder becomes high and worsens the compactability. Accordingly, it is limited to be not more than 0.30%. Preferably, the content of Mn is not more than 0.2%.

Ni:≦2.0% (preferably, ≦0.1%)

If Ni is not less than 2.0%, an original surface is changed into martensite. As a result, the compactability is worsened and the density of the compresses powders does not rise. Therefore, it is limited to be not more than 2.0%.

Cr: 11 to 22% (preferably Cr: 15.5 to 18.5%)

With less than 11% of Cr, a sufficient corrosion resistance cannot be provided. If it is not less than 22%, the powders are hardened. Accordingly, since the density is lowered and the elongation becomes small, the lower limit and the upper limit are set to be 11% and 22%, respectively. A preferable content is 15.5 to 18.5%.

Mo:≦3.0% (preferably Mo: 0.01 to 3.0%, and more preferably 0.8 to 2.1%)

With more than 3.0%, the powders are remarkably hardened, and the compactability is worsened. Accordingly, it is limited to be not more than 3.0%. It is preferably 0.01 to 3.0%, and more preferable is 0.8 to 2.1%.

B: between not less than 0.03% and less than 0.2% (preferably B: 0.05 to 0.15%)

With a content of less than 0.03%, the addition of B is hardly effective, and the corrosion resistance is not specially changed. On the other hand, with a content of not less than 0.2%, the sintered body is hardened to cause the ductility to lower. The elongation characteristic after corrosion is equivalent to or less than no B addition, whereby the B addition is meaningless. If B is much added, the liquid phase appears, and a coefficient of contraction is made large and the size precision is worsened. In the present invention, therefore, B is set to be between not less than 0.03% and less than 0.2%. Preferable is 0.05 to 0.15%.

For solidifying carbides, Nb can be added not more than 1.0%.

EXAMPLES

Examples of the present invention will be discussed in detail.

To the powders of the chemical composition shown in Table 1, CrB powders (average particle size: 16.6 μm) shown in the same and Fe—B powders (average particle size: 14.1 μm) were added at addition amounts shown in Tables 2, 3 and Tables 4, 5, and mixed for 30 minutes together with a lubricant (zinc stearate 1%) in a blender.

Incidentally, the addition amount of CrB and Fe—B is exhibited as a ratio based on the amount of P434L or P444L powder. The content amount of B is exhibited as a ratio based on the total amount of the mixed powder. Table 1 Chemical Composition of powders (wt%)

TABLE 1

| | Chemical Composition of powders (wt %) | | | | | | | | | | |
|---|---|---|---|---|---|---|---|---|---|---|---|
| | C | Si | Mn | P | S | Cu | Ni | Cr | Mo | N | O |
| P434L | 0.013 | 0.85 | 0.23 | 0.024 | 0.005 | — | 0.12 | 16.73 | 0.83 | 0.025 | 0.20 |
| P444L | 0.011 | 0.87 | 0.20 | 0.020 | 0.005 | 0.04 | 0.11 | 17.80 | 1.83 | 0.024 | 0.23 |
| CrB | 0.28 | — | — | — | — | — | — | Bal. | — | B = 16.64 | |
| Fe—B | 0.025 | 1.13 | — | 0.023 | 0.003 | — | — | — | — | B = 20.71 | |

TABLE 2

| The addition amount of CrB to 434L and the sintered density (Compacting pressure 8t/cm$^2$) | | | | | | | | |
|---|---|---|---|---|---|---|---|---|
| CrB content (%) | | 0 | 0.25 | 0.50 | 0.75 | 1.00 | 1.25 | 1.50 |
| B content (%) | | 0 | 0.041 | 0.083 | 0.124 | 0.165 | 0.205 | 0.246 |
| Sintered Density (g/cm$^3$) | 1150° C. Sintered | 6.82 | 6.91 | 8.89 | 6.87 | 6.83 | 6.81 | 6.81 |
| | 1200° C. Sintered | 6.98 | 7.01 | 7.02 | 6.98 | 6.88 | 6.84 | 6.95 |
| | 1250° C. Sintered | 7.11 | 7.12 | 7.13 | 7.11 | 7.10 | 7.08 | 7.08 |

TABLE 3

| The addition amount of CrB to 444L and the sintered density (Compacting pressure 8t/cm$^2$) | | | | | | | | |
|---|---|---|---|---|---|---|---|---|
| CrB content (%) | | 0 | 0.25 | 0.50 | 0.75 | 1.00 | 1.25 | 1.50 |
| B content (%) | | 0 | 0.041 | 0.083 | 0.124 | 0.165 | 0.205 | 0.246 |
| Sintered Density (g/cm$^3$) | 1150° C. Sintered | 6.87 | 6.92 | 6.90 | 6.88 | 6.82 | 6.81 | 6.81 |
| | 1200° C. Sintered | 6.98 | 6.99 | 6.99 | 6.87 | 6.97 | 6.95 | 6.96 |
| | 1250° C. Sintered | 7.11 | 7.11 | 7.10 | 7.11 | 7.09 | 7.08 | 7.08 |

TABLE 4

| The addition amount of Fe—B to 444L and the sintered density (Compacting pressure 8t/cm$^2$) | | | | | | | | |
|---|---|---|---|---|---|---|---|---|
| CrB content (%) | | 0 | 0.25 | 0.50 | 0.75 | 1.00 | 1.25 | 1.50 |
| B content (%) | | 0 | 0.052 | 0.103 | 0.154 | 0.205 | 0.258 | 0.346 |
| Sintered Density (g/cm$^3$) | 1150° C. Sintered | 6.82 | 6.88 | 6.87 | 6.85 | 6.81 | 6.79 | 6.79 |
| | 1200° C. Sintered | 6.98 | 6.88 | 6.95 | 6.90 | 6.94 | 6.92 | 6.91 |
| | 1250° C. Sintered | 7.11 | 7.08 | 7.09 | 7.09 | 7.08 | 7.06 | 7.06 |

TABLE 5

| The addition amount of Fe—B to 434L and the sintered density (Compacting pressure 8t/cm$^2$) | | | | | | | | |
|---|---|---|---|---|---|---|---|---|
| CrB content (%) | | 0 | 0.25 | 0.50 | 0.75 | 1.00 | 1.25 | 1.50 |
| B content (%) | | 0 | 0.052 | 0.103 | 0.154 | 0.205 | 0.256 | 0.306 |
| Sintered Density (g/cm$^3$) | 1150° C. Sintered | 6.87 | 6.90 | 6.90 | 6.85 | 6.85 | 6.83 | 6.81 |
| | 1200° C. Sintered | 6.98 | 6.98 | 6.94 | 6.90 | 6.92 | 6.91 | 6.90 |
| | 1250° C. Sintered | 7.11 | 7.08 | 7.09 | 7.09 | 7.07 | 7.06 | 7.06 |

The mixed powders were compacted at a pressure of 8 t/cm$^2$ and tensile test pieces were made.

Under a condition of 400° C.×30 min in an 10 atmospheric air, the test pieces were subjected to de-waxing (removing of zinc stearate) and sintered under the following conditions:

In vacuum 1150° C.×60 min–FC (Furnace cooling)

In vacuum 1200° C.×60 min–FC (Furnace cooling)

In vacuum 1250° C.×60 min–FC (Furnace cooling)

The densities of the sintered bodies were investigated, the tensile tests were practiced, the elongations were measured before and after the corrosion resistant tests, and the loss in weight by corrosion was measured.

Figure 2A:
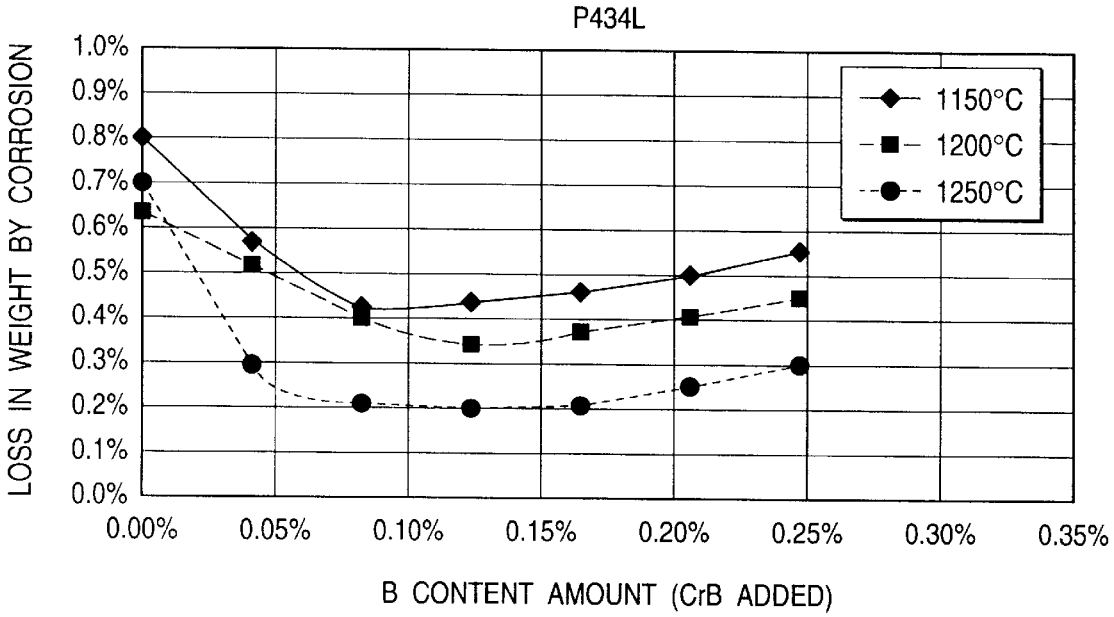
FIG. 2A is a view showing the measured values of the loss in weight by corrosion of the sintered bodies composed of mixed powders where CrB was added to the P434L powders.
Figure 2B:
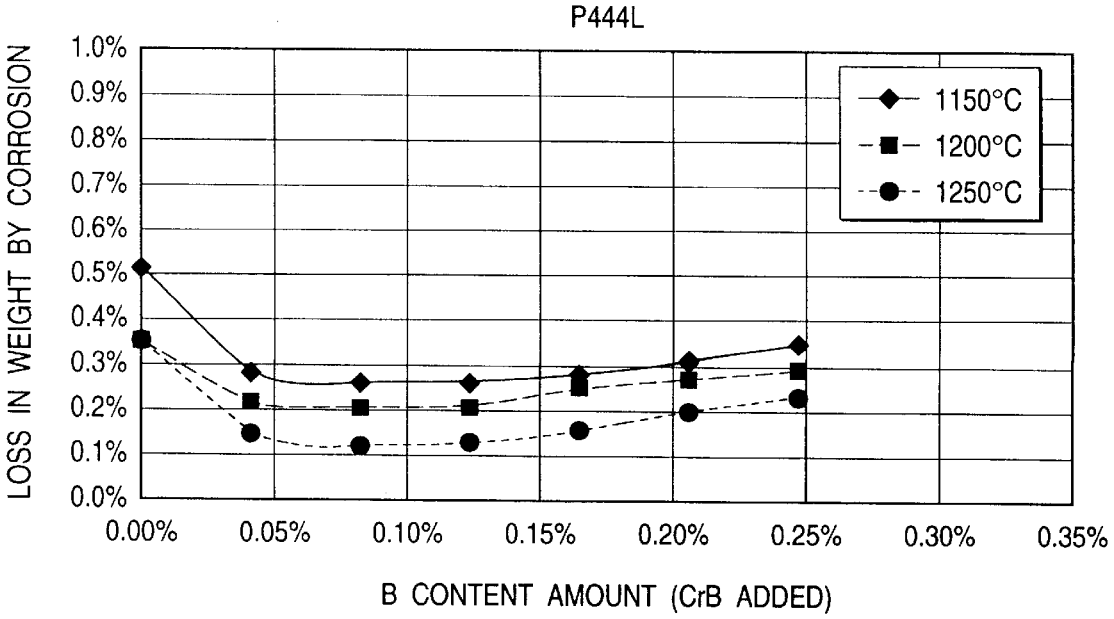
FIG. 2B is a view showing the measured values of the loss in weight by corrosion of the sintered bodies composed of mixed powders where CrB was added to the P444L powders.

Results are shown in tables 2 to 5, FIG. 1 and FIGS. 2(A) and 2(B).

FIG. 1 shows measured values of elongation before and after the corrosion resistance tests with respect to P444L (sintering temperature: 1250° C.). FIG. 2(A) shows measured values of the loss in weight by corrosion with respect to P434L. FIG. 2(B) shows the measured values of the loss in weight by corrosion with respect to P444L.

The conditions of the corrosion resistance tests and measures of the loss in weight by corrosion were as under.

<Corrosion resistance test>

5% salt water spray of 35° C. × 2 hr

↓

Drying of 60° C. × 4 hr

↓

Wetting of 50° C. × 2 hr

The test pieces were immersed, 70° C.×24 hr, in the 30% solution of ammonium citrate, scaled by brushing, again dried, weighed, and measured in the loss in weight before and after the corrosion test.

From the results of FIG. 1, the following facts are understood. In each case of CrB addition and Fe—B addition, the addition of not less than 0.03% B maintains the elongation after the corrosion resistance test higher than no addition of B. The addition effect shows once a maximum and subsequently a gradual falling. When B is around 0.20%, the elongation characteristics are almost equivalent to the cases of no additions of CrB and Fe—B. In addition, the elongation characteristics go down thereafter, as B is increased. Further, as the forms of B addition, CrB is superior to Fe—B.

The better result of CrB than Fe—B is assumed as the following reason.

It is assumed that, in a case of adding B in the form of Fe—B, B combines with Cr existing in the matrix during sintering, and Cr in the matrix is subsequently lessened and causes bad influences to the corrosion resistance. In contrast, the adding form of CrB does not cause such a matter, so that there does not appear the problem of the drop of the corrosion resistance caused by decreasing of Cr in the matrix.

Also in the results of FIGS. 2(A) and 2(B), it is acknowledged that the loss in weight by corrosion goes down by the B addition (CrB addition).

The corrosion resistance is improved, though the density of the sintered body does not notably increase by the B addition as mentioned above. The reason of this fact is assumed due to decreases of the open pores and the continuous pores seen in the upper surface of the sintered body.

FIGS. 10(A) to 10(F) and 11(A) to 11(F) show in passing the states of the upper surfaces of the sintered bodies after the corrosion resistance tests. FIGS. 10(A) to 10(F) show generation conditions of rust when CrB was added to P434L powder. FIGS. 11(A) to 11(F) show generation conditions of rust when CrB was added to P444L powder. It is observed from these photographs that appearance of rusts is effectively checked by adding B 0.03% or more.

That good results are gained in particular at the sintering high temperature of 1250° C. in FIGS. 2 (A) and (B), is considered that partial liquid phases are effectively formed by sintering at the high temperature.

To the chemical compositions of Tables 6 and 7, the same CrB powders as mentioned above were added at amounts of Tables 8 and 9, and test pieces were made with mixed powders in the same manner as described above (the sintering temperature: 1250° C.).

The densities of the sintered bodies were investigated, the tensile tests were practiced before and after the corrosion resistance tests, and the elongations were measured.

TABLE 6

The chemical Composition of powders (wt %)

| | C | Si | Mn | P | S | Ni | Cr | Mo | N | O |
|---|---|---|---|---|---|---|---|---|---|---|
| P444L | 0.062 | 1.87 | 0.16 | 0.013 | 0.006 | 0.11 | 11.78 | 0.15 | 0.034 | 0.14 |
| CrB | 0.28 | — | — | — | — | — | Bal. | — | B = 16.64 | |

TABLE 7

The chemical Composition of powders (wt %)

| | C | Si | Mn | P | S | Ni | Cr | Mo | N | O |
|---|---|---|---|---|---|---|---|---|---|---|
| P (25Cr—1Mo) | 0.008 | 0.88 | 0.13 | 0.007 | 0.006 | 0.13 | 24.87 | 0.94 | 0.033 | 0.39 |
| CrB | 0.28 | — | — | — | — | — | Bal. | — | B = 16.64 | |

TABLE 8

The addition amount of CrB to P410L and the sintered density (8t/cm$^{-2}$-1250° C. sintering)

| CrB content (%) | 0 | 0.25 | 0.50 | 0.75 | 1 | 1.25 | 1.5 |
|---|---|---|---|---|---|---|---|
| B content (%) | 0 | 0.041 | 0.083 | 0.124 | 0.165 | 0.205 | 0.246 |
| Sintered Density (g/cm$^3$) | 7.27 | 7.29 | 7.3 | 7.3 | 7.29 | 7.27 | 7.27 |

TABLE 9

The addition amount of CrB to P (25Cr—1Mo) and the sintered density (8t/cm$^2$-1250° C. sintering)

| CrB content (%) | 0 | 0.25 | 0.50 | 0.75 | 1 | 1.25 | 1.5 |
|---|---|---|---|---|---|---|---|
| B content (%) | 0 | 0.041 | 0.083 | 0.124 | 0.165 | 0.205 | 0.246 |
| Sintered Density (g/cm$^3$) | 6.5 | 6.52 | 6.54 | 6.52 | 6.53 | 6.53 | 6.5 |

Figure 3:
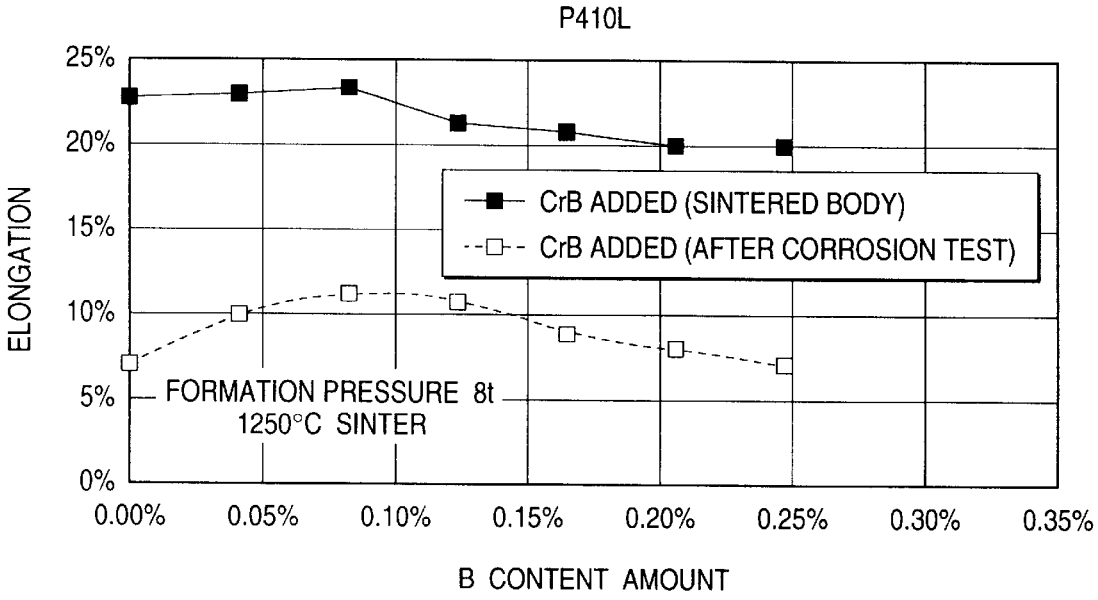
FIG. 3 is a view showing the elongation characteristics of the sintered bodies composed of mixed powders where CrB was added to the P410L powders.

As shown in FIG. 3, when CrB was added to P410L containing Cr as little as around 12%, since the elongation before the corrosion resistance test was large, the decreasing degree of the elongation value was large when those were compared before and after the corrosion resistance tests. However, an absolute value of the elongation after the corrosion resistance test was kept at a constant level. The effect of the CrB addition appears anyway (comparing the corrosion resistances before and after in previous P444L, the decreasing degree of the elongation after the corrosion resistance test was small).

Figure 4:
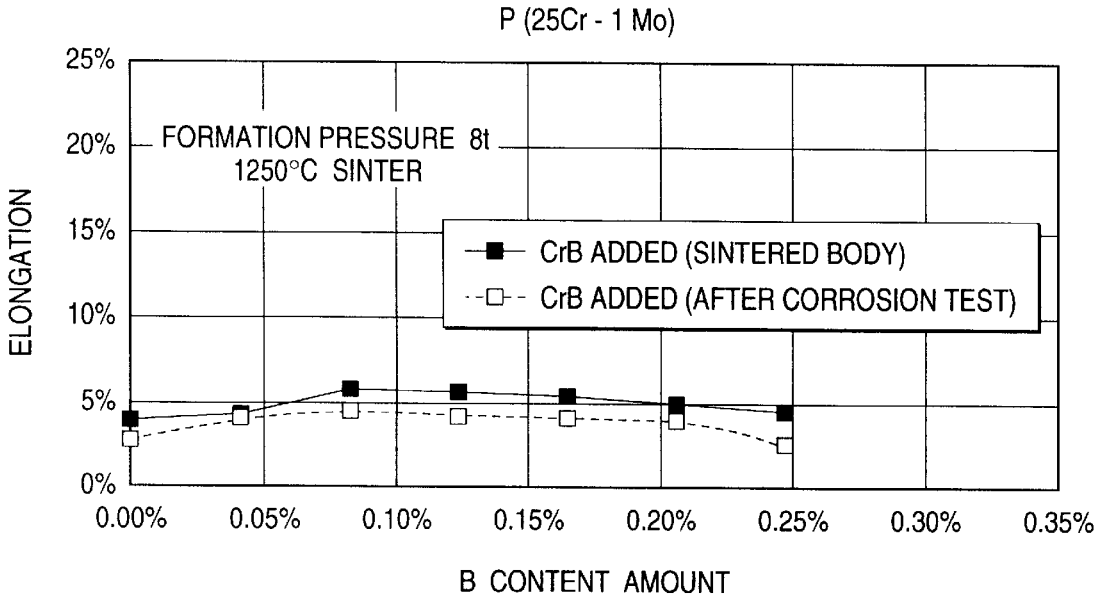
FIG. 4 is a view showing the elongation characteristics of the sintered bodies composed of mixed powders where CrB was added to the P(25Cr—1Mo) powders.

On the other hand, in the case of the P (25Cr—1Mo) powders of Cr as much as around 25% (see FIG. 4), the elongation was already small before the corrosion resistance test since Cr is much. Therefore, although the decreasing degree of the elongation after the corrosion resistance test was small by the CrB addition, the absolute value of the elongation after the corrosion resistance test was lowered. Accordingly, this is unsuitable for those demanded with respect to large elongation after the corrosion resistance test such as the above mentioned sensor rings.

To the powders P (21Cr—0.5Mo) of the chemical compositions of Table 10, the same CrB powders as mentioned above were added at amounts of Table 11. Test pieces were made with mixed powders in the same manner as said above (the sintering temperature: 1250° C.).

The densities of the sintered bodies were investigated, the tensile tests were practiced before and after the corrosion resistance tests, and the elongations were measured.

TABLE 10

| The chemical Composition of powders (wt %) | | | | | | | | | | |
|---|---|---|---|---|---|---|---|---|---|---|
| | C | Si | Mn | P | S | Ni | Cr | Mo | N | O |
| P(25Cr—1Mo) | 0.004 | 1.77 | 0.08 | 0.001 | 0.002 | 0.02 | 21.35 | 0.48 | 0.022 | 0.18 |
| CrB | 0.28 | — | — | — | — | — | Bal. | — | B = 16.64 | |

TABLE 11

| The addition amount of CrB to P(21Cr—0.5Mo) and the sintered density (8t/cm$^2$-1250° C. sintering) | | | | | | | |
|---|---|---|---|---|---|---|---|
| CrB content (%) | 0 | 0.25 | 0.50 | 0.75 | 1 | 1.25 | 1.5 |
| B content (%) | 0 | 0.041 | 0.083 | 0.124 | 0.165 | 0.205 | 0.246 |
| Sintered Density (g/cm$^3$) | 7.01 | 7.05 | 7.05 | 7.03 | 7.02 | 7.00 | 6.99 |

TABLE 12

| Elongation (%) | | | |
|---|---|---|---|
| Powders | B Content (%) | Sintered Bodies | After Corrosion Resistant Tests |
| P(21Cr—0.5Mo) | 0.000 | 17.1 | 7.5 |
| | 0.041 | 18.2 | 13.1 |
| | 0.083 | 18.3 | 14.5 |
| | 0.124 | 18.0 | 13.0 |
| | 0.168 | 17.2 | 11.9 |
| | 0.205 | 15.8 | 10.6 |
| | 0.246 | 14.2 | 9.8 |

Figure 5:
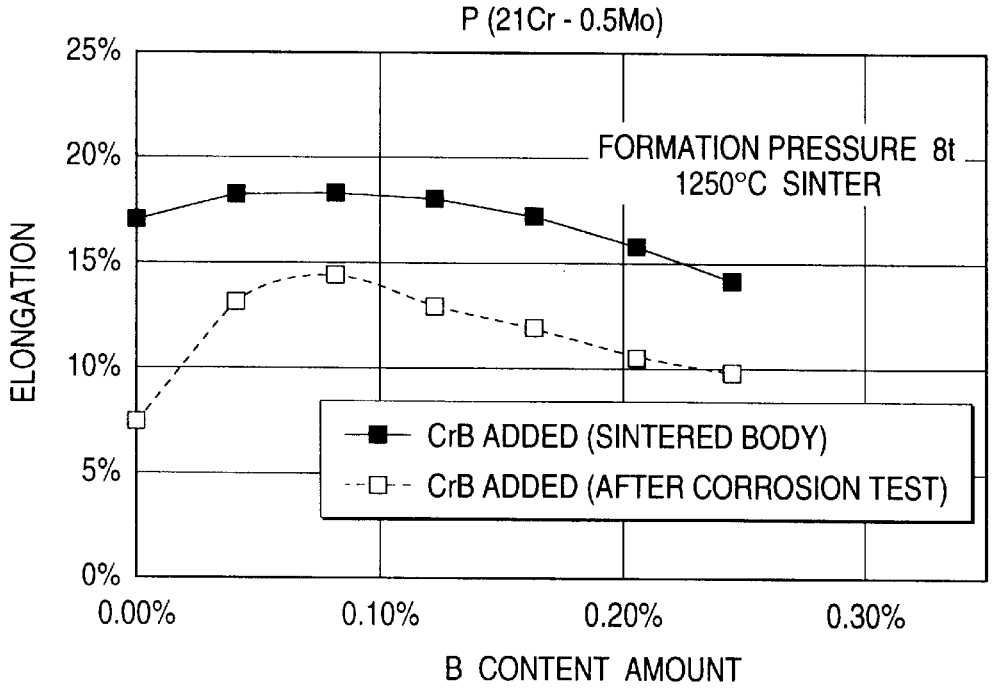
FIG. 5 is a view showing the elongation characteristics of the sintered bodies composed of mixed powders where CrB was added to the P (21Cr—0.5Mo) powders.

As shown in Table 12 and FIG. 5, also when, to the P (21Cr—0.4Mo) powders where Cr was near the upper limit 22% of the invention, CrB was added not less than 0.03% to less than 0.2%, the effect of adding CrB apparently appeared.

Namely, in the present invention, when the metal compound of B is added to powders of ferrite stainless steel of not more than 22% Cr, high elongation characteristics can be provided after the corrosion resistance test.

With respect to the powders P444L of the chemical composition shown in Table 1, 1% of zinc stearate was incorporated respectively into the powders added and mixed with 0.5% of CrB and the P444L powders without addition of CrB. Those mixtures were press-compacted under a pressure of 6t/cm$^2$ into 10 mm thicknesses by means of the metal ring mold of an outer diameter ϕ34 mm and an inner diameter ϕ20 mm.

The density of the compressed powders was then both 6.1 g/cm$^3$.

Those formed bodies were de-waxed 500° C.×30 min in a vacuum and thereafter sintered 1250° C.×60 min in the vacuum.

The sintered densities then were both 7.0 g/cm$^3$.

Figure 6:
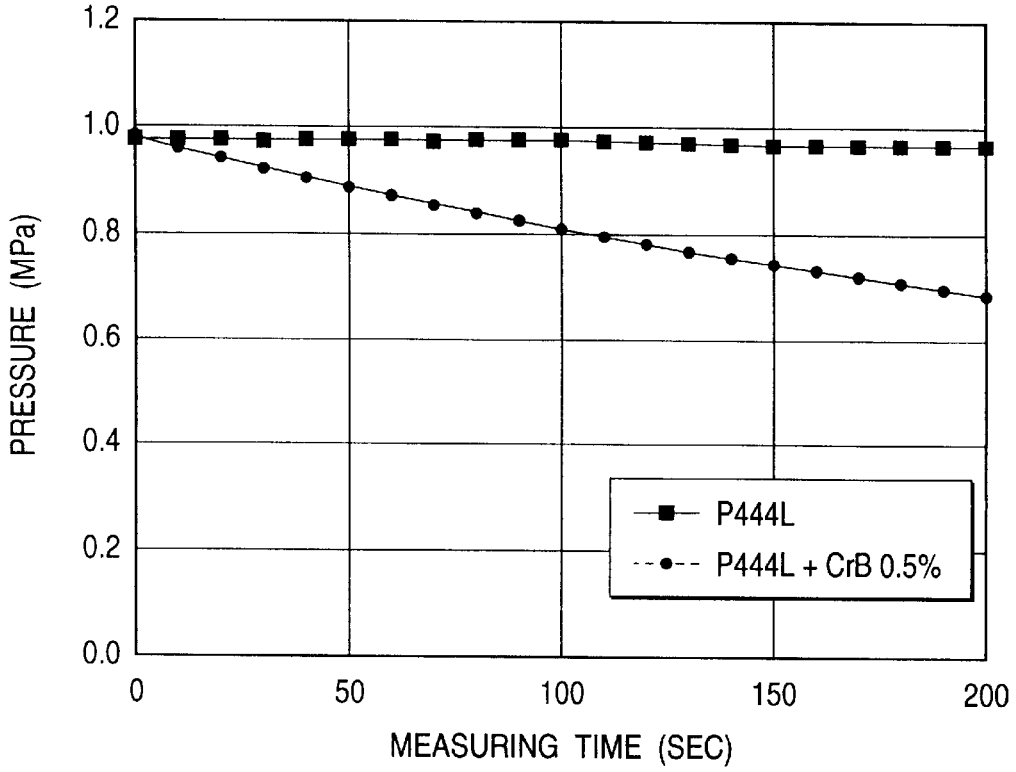
FIG. 6 is a view showing measured results of air tightness of the sintered body of the mixed powders where CrB was added to the P444L powders in a comparison with powder sintered body without addition of CrB.

Both sintered bodies were measured in air tightness by applying the pressure of about 0.98 MPa, and the results shown in FIG. 6 were provided.

Figure 7:
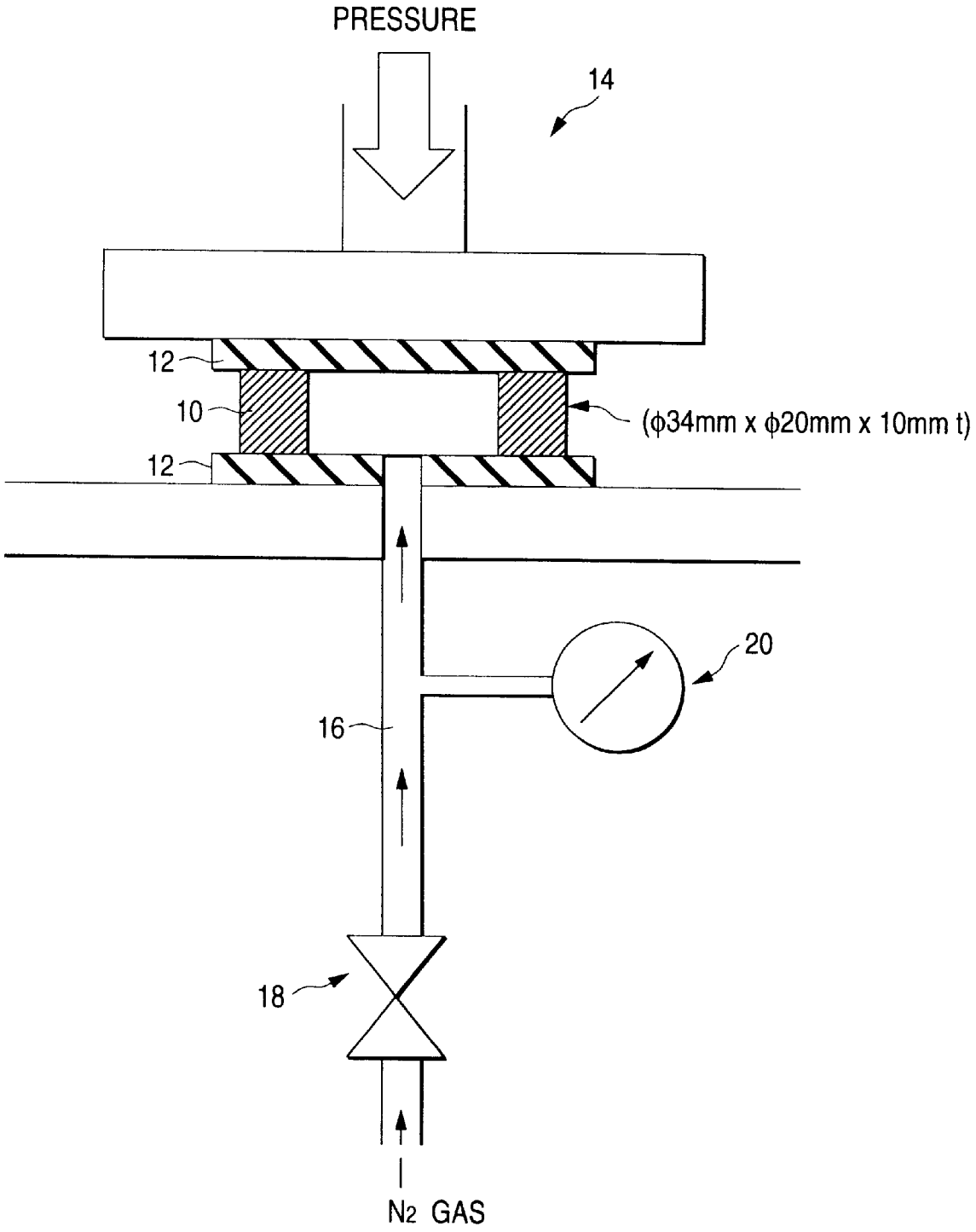
FIG. 7 is an explanation view of a test method for air tightness evaluation of a sintered body ring.

The measurement test of air tightness was performed in the method exhibited in FIG. 7.

Namely, while opposite end surfaces of a sintered body ring 10 was closed by a rubber packing 12, it was pressed by an air cylinder 14 to maintain air tightness (pressure force: about 20 kgf/cm$^2$ (19.6 Mpa)). Under this condition, $N_2$ gas at a pressure of 1 kgf/cm$^2$ (0.98 Mpa)was introduced into the inside of the sintered ring 10 through an tube 16. Then, when the interior pressure of the sintered ring 10 was achieved to 0.98 Mpa (measured by a pressure meter 20), a valve 18 was closed and the reduction of the pressure with passing time was measured.

As seen in the results of FIG. 6, the interior pressure of the sintered body of P444L powders without addition of CrB went down, while the decrease in pressure of the sintered body added and mixed with 0.5% CrB was scarcely recognized.

This is because in the case of the sintered body of powders added with Cr, since the continuous pores were remarkably decreased, no leakage occurred.

Further, compressed powder bodies of mixture powder in which 0.25 to 1.25 wt % of CrB were added to respective P434 powder and P444L powder were sintered in vacuum at 1100° C. to 1290° C. for 60 minutes to thereby produce sintered bodies having a density of about 7 g/cm$^3$. Then, the elongation, the continuous pore ratio and the air tightness of the sintered bodies were evaluated in the following manner.

(1) Elongation

In order to apply the sintered body to a sensor ring, it is necessary to prevent crack due to expansion accompanying with the corrosion of an opposite material. For such a purpose, it is necessary to suppress lowering the ductility and the strength.

Here, the crack (elongation) during compressed insertion as the ductility evaluation after a corrosion test in a sensor shape which is one of corrosion resistance evaluations required for the sensor body.

The test conditions are indicated as follows.

Figure 8:
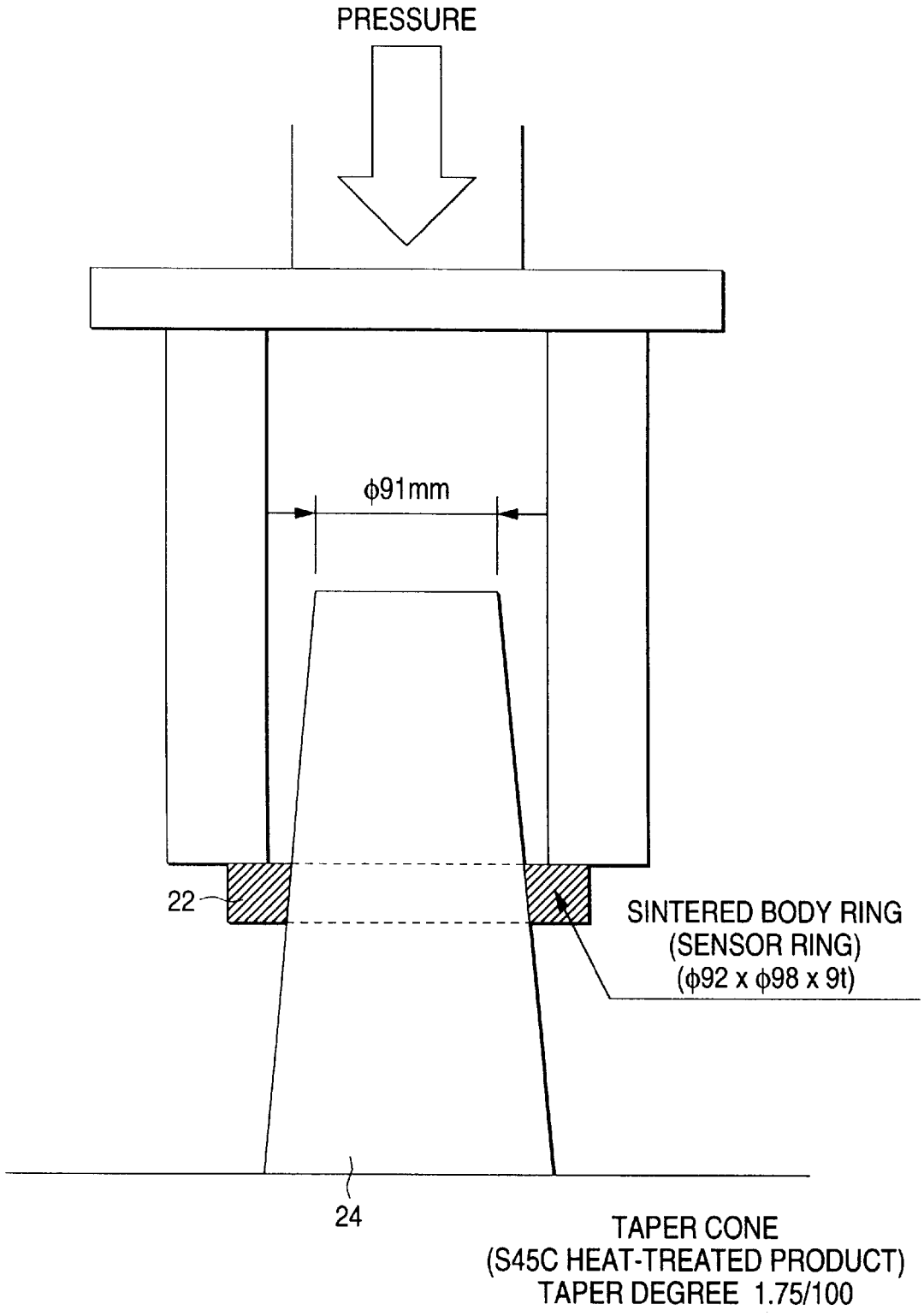
FIG. 8 is an explanation view of a measurement method for ductility evaluation of a sintered body ring.

A sintered body ring 22 (sensor ring sample: see FIG. 8) having an outer diameter of ϕ98 mm, an inner diameter of ϕ92 mm, and a length of 9 mm was used. The elongation of the sintered body ring before and after the corrosion test was measured in a method exhibited in FIG. 8.

That is, the sintered ring 22 was compressedly inserted into a taper cone 24 having a taper degree of 1.75/100. The elongation was calculated from the inner diameter when the sintered body 22 was cracked and the inner diameter before the compressed insertion. Incidentally, the elongation ratio was obtained in the following manner.

Elongation={(inner diameter when crack)/(inner diameter before compressed insertion)}×100 (%)

Incidentally, the corrosion resistance test was performed in the following condition.

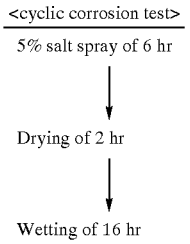

The above was one cycle (24 hours), and was repeated for 2400 hours.

The results are exhibited in Table 13.

As seen in Table 13, the sintered body rings according to the present invention exhibits satisfy not less than 4% of the elongation after the corrosion test. It is confirmed that the sintered rings could be sufficiently used for a sensor rings.

TABLE 13

| Base Material | | No. | CrB addition amount (wt %) | B content amount (wt %) | Sinter Temp. (° C.) | Density (g/cm$^3$) |
|---|---|---|---|---|---|---|
| P434L | Example | 1 | 0.25 | 0.041 | 1250 | 7.13 |
| | | 2 | 0.50 | 0.083 | 1250 | 7.12 |
| | | 3 | 1.00 | 0.165 | 1250 | 7.15 |
| | | 4 | 1.00 | 0.165 | 1200 | 7.11 |
| | | 5 | 0.50 | 0.083 | 1100 | 7.08 |
| | | 6 | 0.50 | 0.083 | 1290 | 7.18 |
| | Comparative Example | 7 | — | — | 1250 | 7.13 |
| | | 8 | — | — | 1100 | 7.09 |
| | | 9 | 0.12 | 0.020 | 1250 | 7.12 |
| | | 10 | 1.30 | 0.216 | 1250 | 7.08 |
| P444L | Example | 11 | 0.50 | 0.083 | 1250 | 7.14 |
| | | 12 | 1.00 | 0.165 | 1250 | 7.10 |
| | | 13 | 0.50 | 0.083 | 1100 | 7.07 |
| | | 14 | 0.50 | 0.083 | 1290 | 7.17 |
| | Comparative Example | 15 | — | — | 1260 | 7.13 |
| | | 16 | — | — | 1100 | 7.04 |
| | | 17 | 0.12 | 0.020 | 1250 | 7.09 |
| | | 18 | 1.30 | 0.216 | 1250 | 7.10 |

| | Elongation (%) | | | | air tightness (MPa) | | |
|---|---|---|---|---|---|---|---|
| No. | before test | after test | reduction ratio | continuous pore ratio (%) | initial pressure | final pressure | pressure reduction ratio (%) |
| 1 | 20.5 | 9.0 | 56.1 | 11.1 | 0.986 | 0.983 | 0.3 |
| 2 | 20.3 | 11.8 | 41.9 | 7.2 | 0.988 | 0.988 | 0.0 |
| 3 | 20.7 | 9.7 | 53.1 | 10.3 | 0.986 | 0.985 | 0.1 |
| 4 | 19.3 | 8.5 | 56.0 | 12.6 | 0.988 | 0.968 | 0.0 |
| 5 | 15.2 | 6.5 | 57.2 | 14.3 | 0.985 | 0.951 | 3.5 |
| 6 | 20.8 | 13.5 | 35.1 | 6.3 | 0.986 | 0.986 | 0.0 |
| 7 | 18.5 | 4.3 | 76.8 | 22.7 | 0.988 | 0.546 | 41.7 |
| 8 | 13.2 | 3.4 | 74.2 | 40.0 | 0.985 | 0.326 | 66.9 |
| 9 | 20.0 | 5.2 | 74.0 | 20.2 | 0.986 | 0.885 | 10.2 |
| 10 | 19.6 | 6.9 | 65.0 | 12.0 | 0.989 | 0.989 | 0.0 |
| 11 | 18.4 | 10.4 | 43.5 | 8.9 | 0.985 | 0.985 | 0.0 |
| 12 | 19.1 | 9.2 | 51.8 | 9.9 | 0.985 | 0.984 | 0.1 |
| 13 | 14.5 | 7.8 | 46.2 | 14.2 | 0.988 | 0.945 | 4.4 |
| 14 | 19.4 | 12.1 | 37.6 | 6.2 | 0.989 | 0.989 | 0.0 |
| 15 | 18.2 | 4.7 | 74.2 | 22.3 | 0.987 | 0.692 | 40.0 |
| 16 | 11.1 | 2.9 | 73.9 | 41.3 | 0.987 | 0.311 | 68.5 |
| 17 | 16.5 | 5.2 | 68.5 | 21.0 | 0.987 | 0.878 | 11.0 |
| 18 | 17.0 | 6.3 | 63.0 | 10.0 | 0.988 | 0.988 | 0.0 |

(2) Continuous pore ratio

In case of compacting the sensor ring by the sintered body, if pores which open at the surface and continue to the inside of the sintered body, water and the like from the outside enters through the pores from the surface of the sintered body to the inside of the sintered body. As a result, corrosion progresses from the inside of the sintered body, to thereby cause lowering the ductility of the sensor ring.

The sintered body ring was produced in the same manner as described in (1). The continuous pore ratio was measured in the following manner.

Test condition: the sintered body ring having an inner diameter of ϕ20 mm, an outer diameter of ϕ34 mm, and a length of ϕ10 mm was molded and sintered so that the final density became 7.1 g/cm$^3$. An oil content volume was measured by using thus produced sintered body ring. The continuous pore ratio was obtained by the results of the measurement.

Here, the continuous pore ratio was obtained by the following formula.

Continuous pore ratio={(oil content ratio$^{*1}$/whole pore ratio)×100=[(oil content volume)/{1−(sintered body density$^{*2}$)/(theoretical density)}]×100

(*1) oil content ratio: volume ratio of continuous pores opening at the surface of the sintered body to the whole of the sintered body (*2) sintered body density: (weight of sintered body)/(volume of the sintered body)

A process of the measurement were as follows.

First, the sintered body was placed in vacuum, and an oil is impregnated into the sintered body. Then, the volume of the impregnated oil was calculated by the vacuum impregnation method. The volume of the content oil at this time corresponds to the volume due to the continuous pores.

Separately, the volume of the sintered body and the density of the sintered body had been obtained, and they were substituted for the above formula to thereby obtain the continuous pore ratio.

The theoretical density used was 7.8 g/cm$^3$.

The results are shown in Table 13.

As seen from the results in Table 13, in examples according to the present invention, the continuous pore ratio was not more than 20 vol. %, and good characteristic was exhibited after the corrosion test.

(3) Air tightness

The sintered body ring having an outer diameter of ϕ34 mm, an inner diameter of ϕ20 mm and a length of 10 mm was used to conduct the air tightness evaluation test as shown in FIG. 7.

Incidentally, nitrogen gas was introduced into the interior of the sintered body ring at 0.98 MPa. This initial pressure and a pressure after 180 minutes were measured to thereby obtain the reduction ratio of the pressure before and after the test.

The results are exhibited in Table 13.

The smaller the continuous pore on the surface of the sintered body is, the smaller the reduction of the pressure is. Therefore, it is possible to obtain high air tightness.

In any of the examples according to the present invention in which the continuous pore ratio is not more than 20%, the pressure reduction ratio with respect to the initial pressure is not more than 5%. Particularly, when the continuous pore ratio is not more than 14%, the pressure reduction ratio is not more than 1%. Accordingly, in this case, it was ascertained to have high air tightness.

Figure 9A:
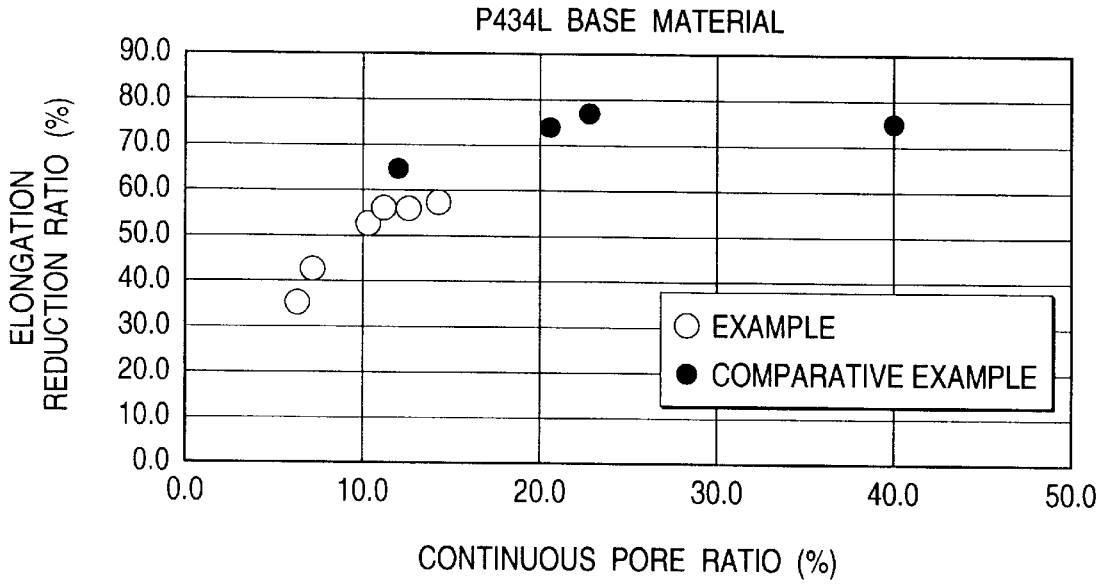
FIGS. 9(A) and 9(B) are views showing a relationship between a continuous pore ratio and an elongation reduction ratio before and after the corrosion test concerning to a measured sintered body ring.
Figure 9B:
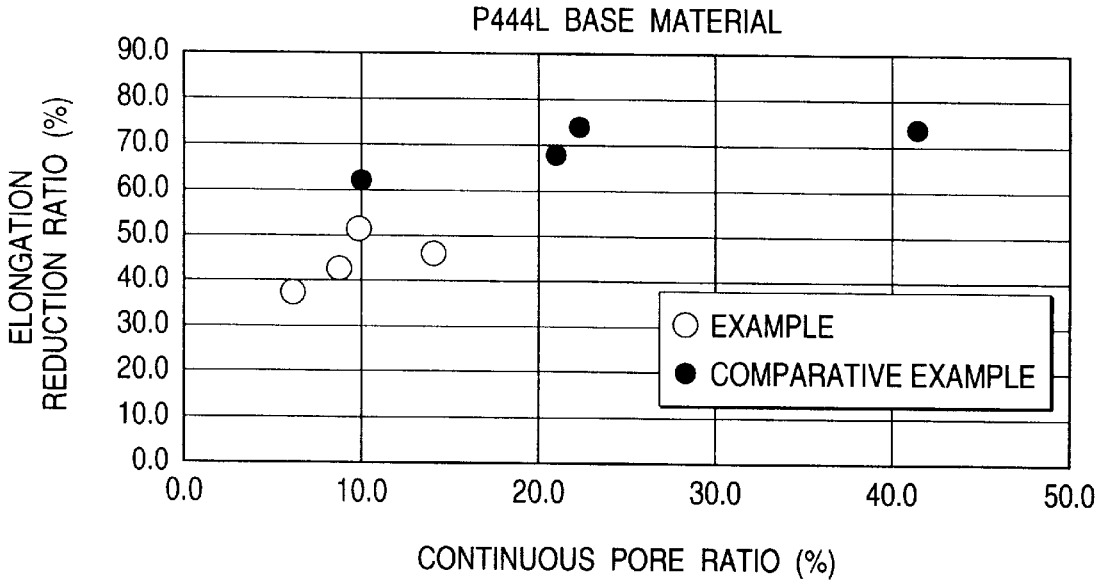
Figure 10:
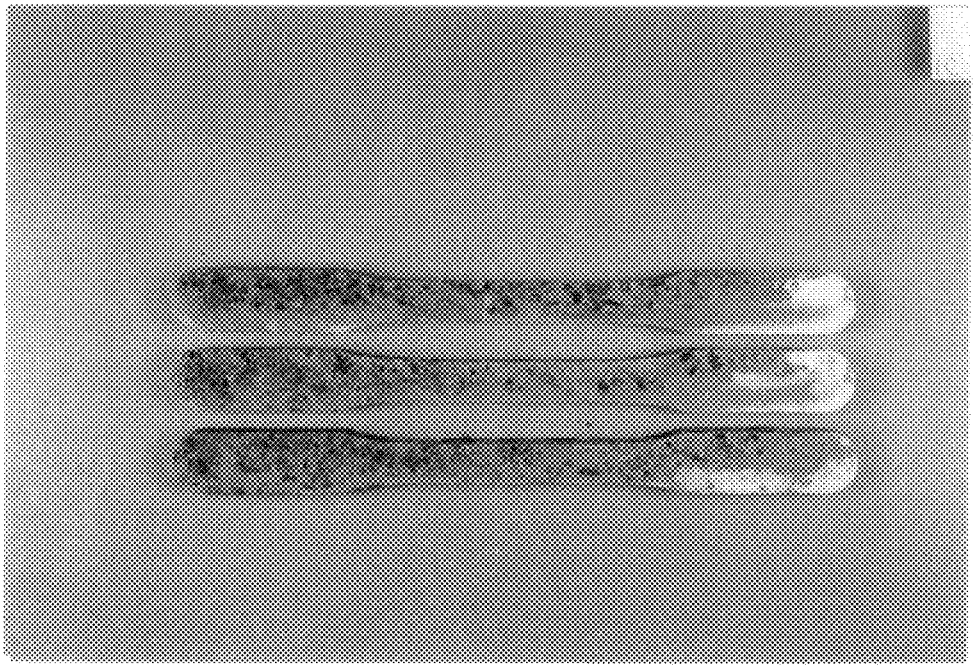
FIGS. 10(A) to 10(F) show generation conditions of rust when CrB was added to P434L powder.
Figure 11:
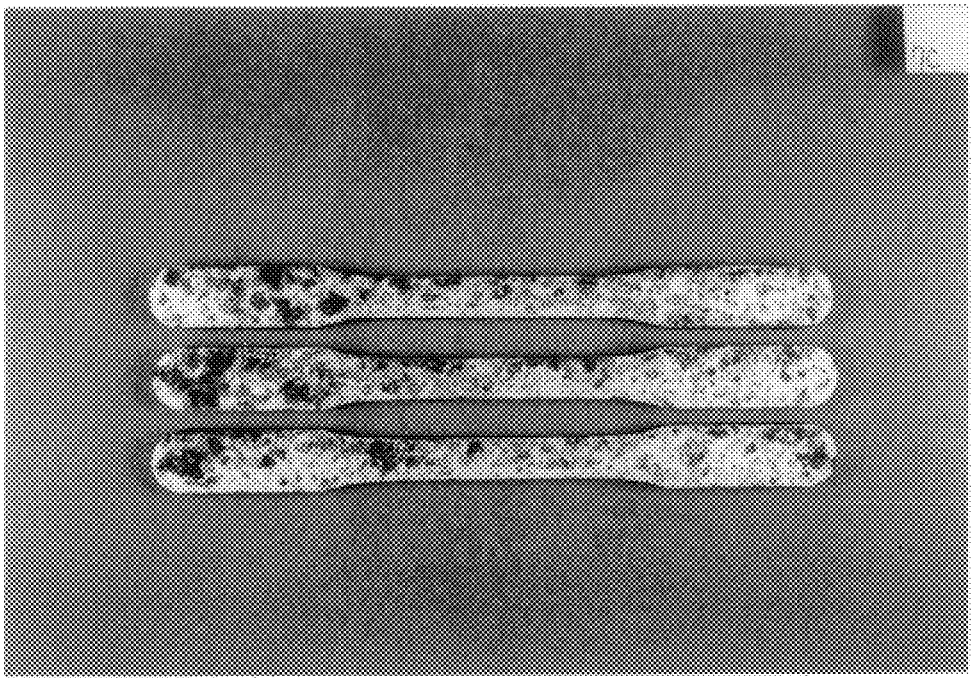
FIGS. 11(A) to 11(F) show generation conditions of rust when CrB was added to P444L powder.
Figure 10:
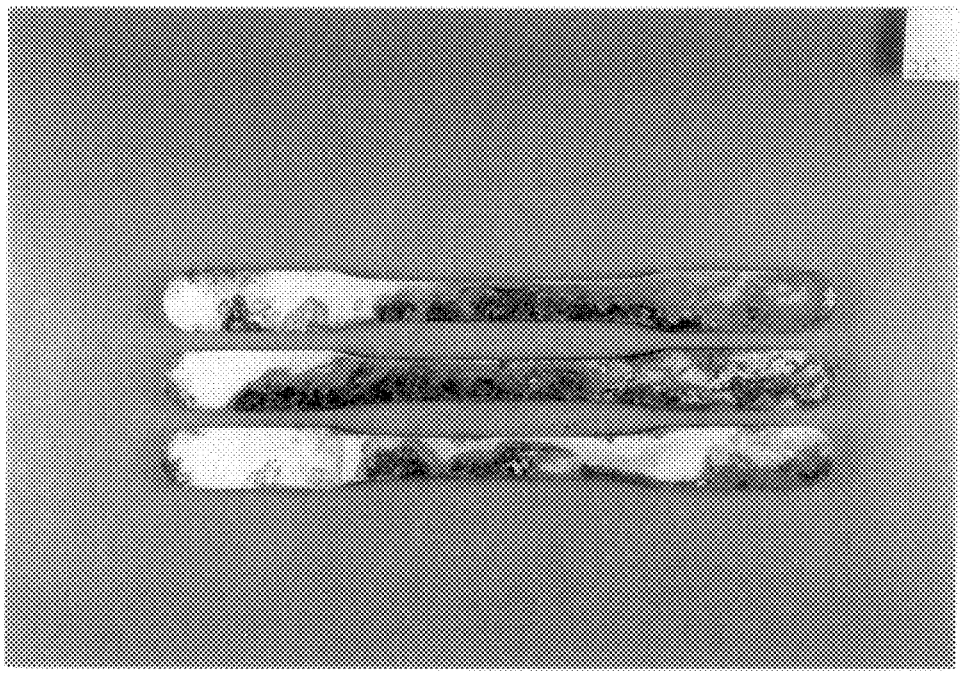
Figure 11:
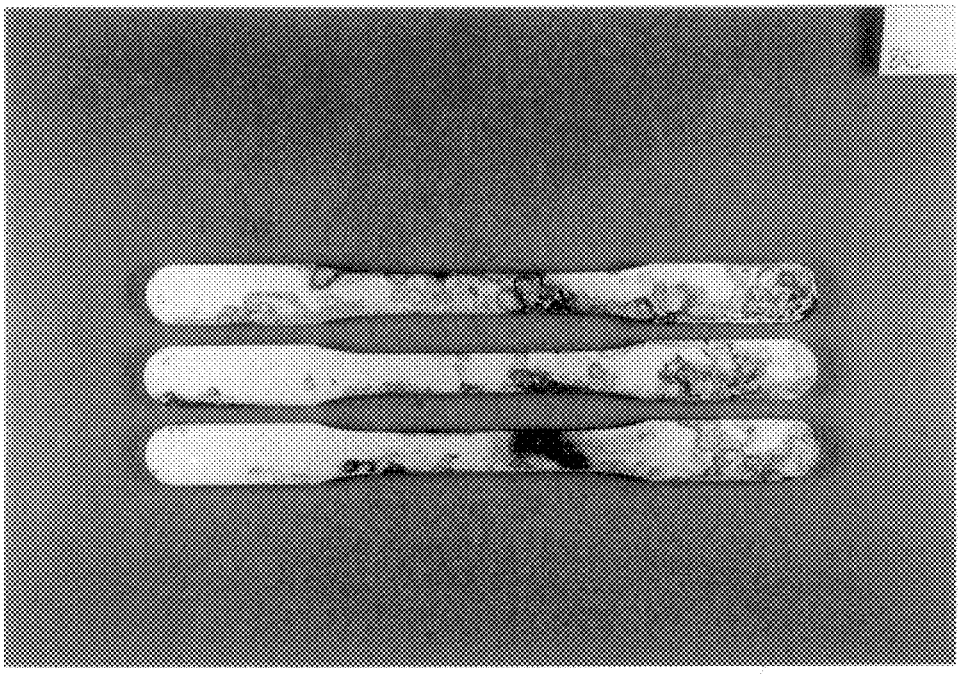
Figure 10:
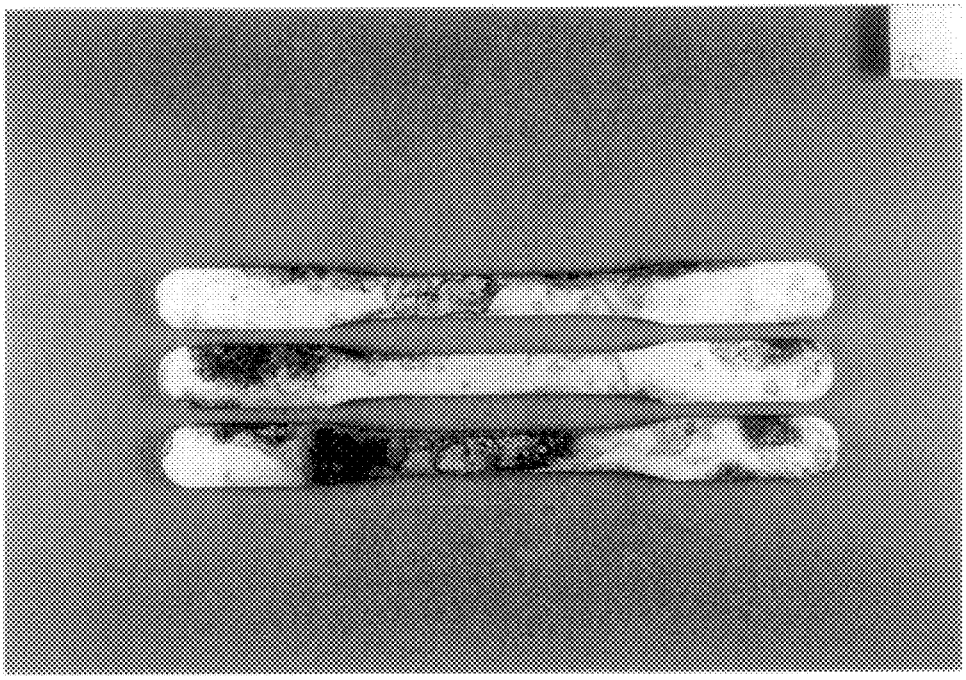
Figure 11:
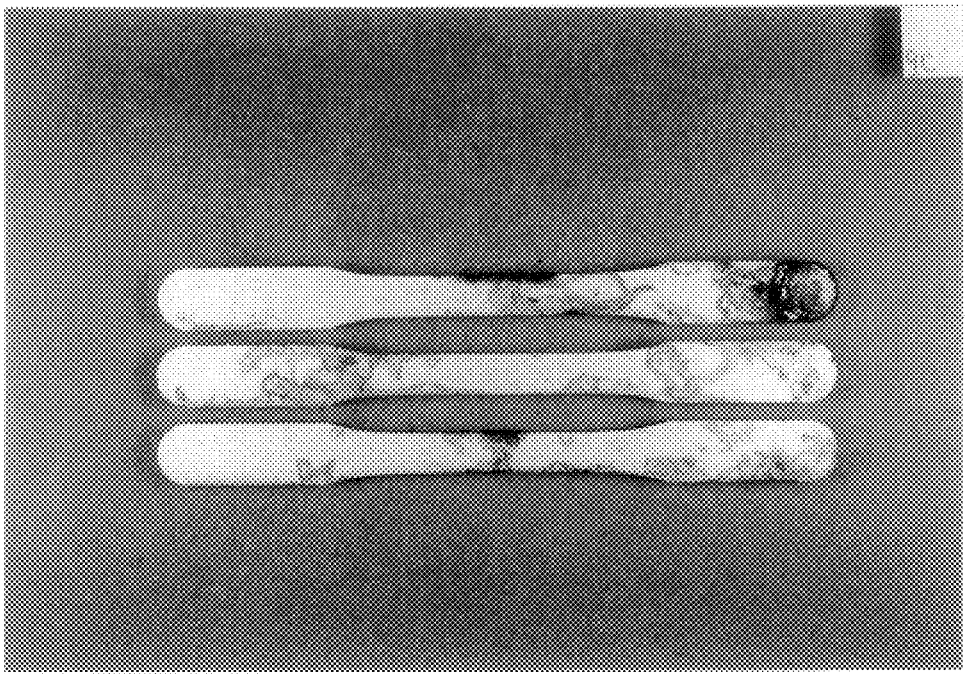
Figure 10:
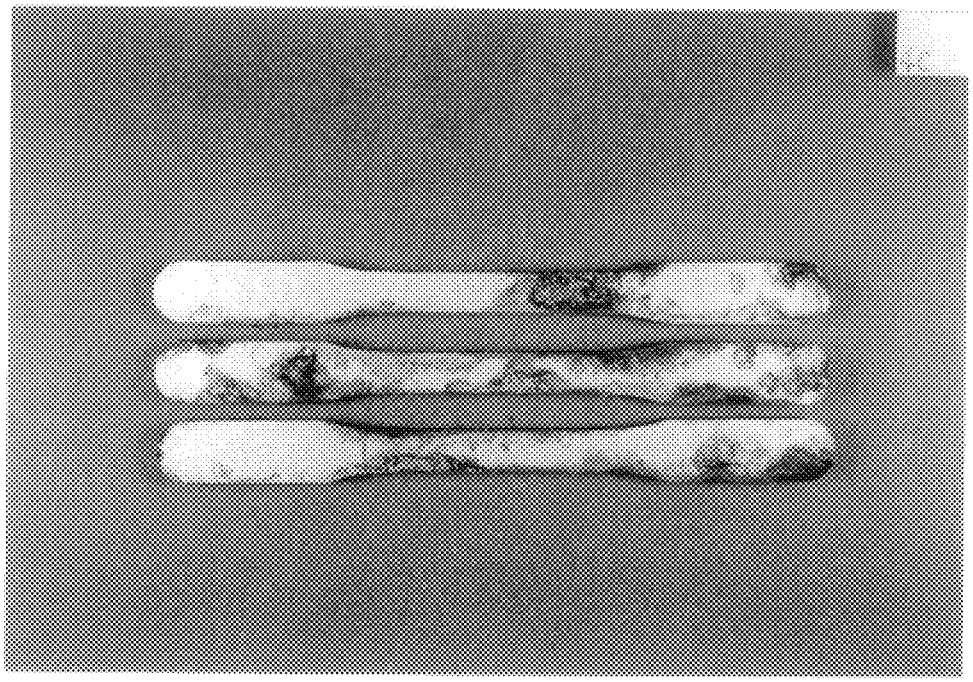
Figure 11:
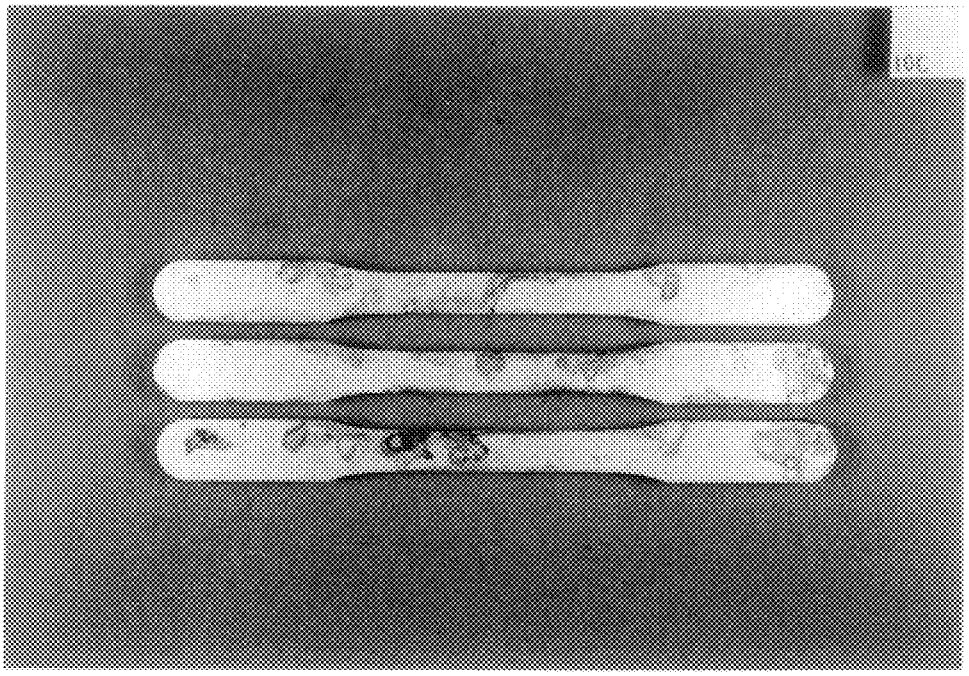
Figure 10:
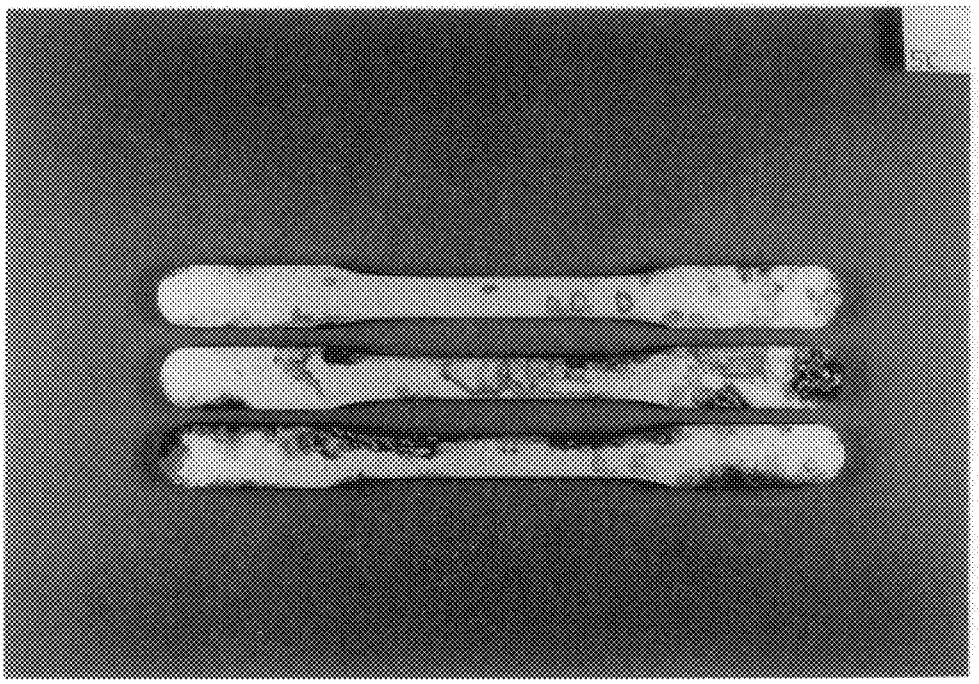
Figure 11:
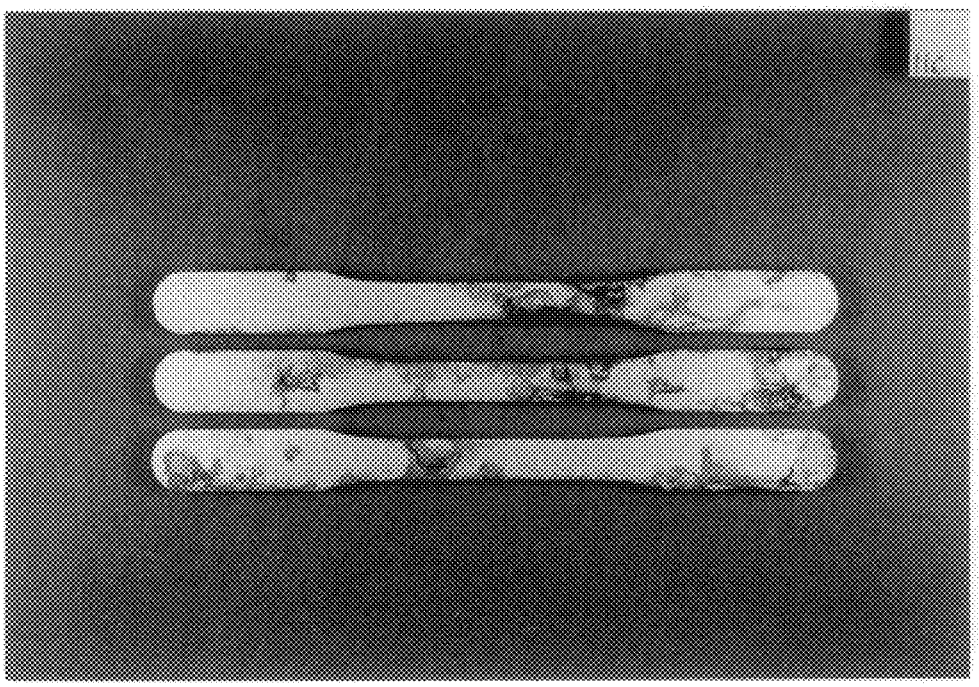
Figure 10:
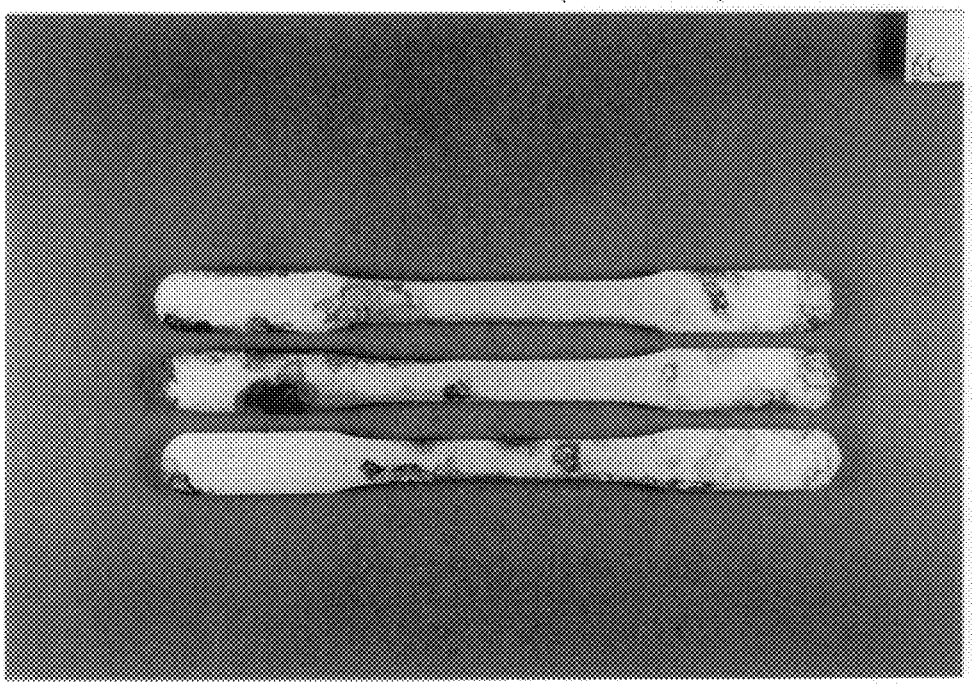
Figure 11:
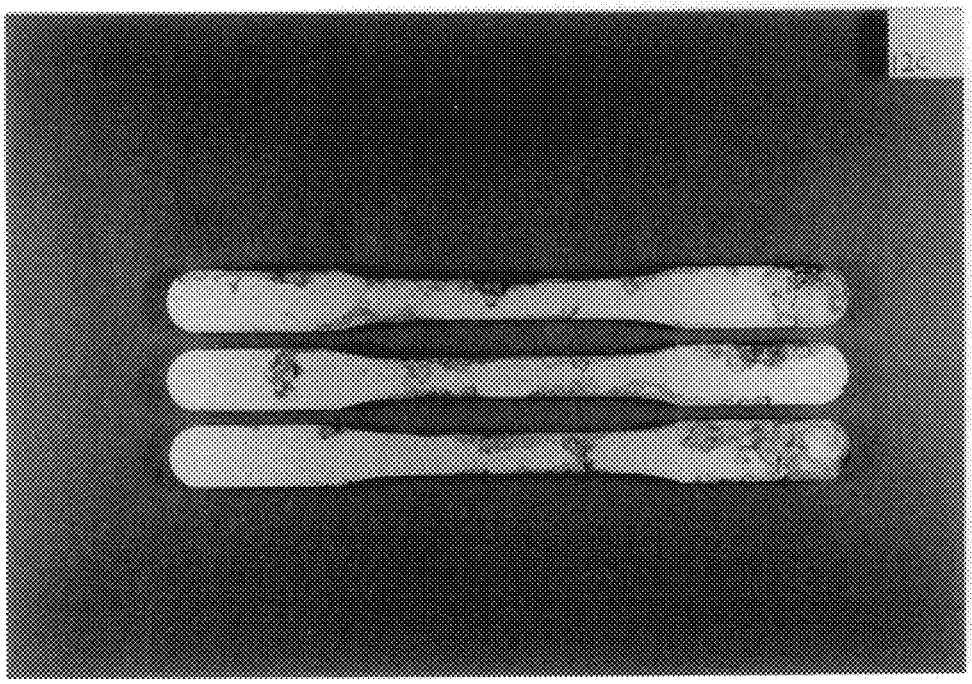

FIGS. 9(A) and 9(B) show a relationship between a continuous pore ratio and an elongation reduction ratio before and after the corrosion test. As shown in these graphs, there is a close relationship between the continuous pore ratio and the elongation reduction ratio. Namely, the higher the continuous pore ratio is, the higher the elongation reduction ratio is.

If the continuous pore ratio is not more than 20%, the elongation reduction ratio is not more than 70%. Particularly, if the continuous pore ratio is not more than 14%, the elongation reduction ratio is not more than 60%.

According to this fact, it is recognized the following matters. Namely, the continuous pore ratio is controlled to be small value to thereby suppress the reduction of the elongation after corrosion. Further, in case of the sintered body according to the present invention, since the continuous pore ratio is small, it has a good elongation characteristic even after corrosion.

The above mentioned refers to the only examples according to the present invention. The present invention is practicable so far as not getting out of the subject matter thereof.

As mentioned in detail, the sintered body provided by sintering, at temperatures of not less than 1050 to less than 1300° C., powders which are composed by adding, according to claim 1, metal compound of B within the predetermined range to powders of ferrite stainless steel containing Cr 11 to 22%, has the excellent corrosion resistance and the high elongation characteristic after corrosion.

Therefore, when it is applied to the sensor ring, the occurrence of cracks can be avoided from the sensor ring and in the sensor ring by corrosions in shafts of opposite matters. Alternatively, when it is applied to engagement part except the sensor ring, the corrosion resistance and the ductility can be made good.

Further, the powder composed of the ferrite stainless steel powder containing not more than 0.1% of C, not more than 3.0% of Si, not more than 0.30% of Mn, not more than 2.0% of Ni, 11 to 22% of Cr and not more than 3.0% of Mo, to which the metal compound of B is added, is used and sintered to thereby produce the sintered body. Accordingly, when the sintered body is used itself and is used as a part composed of the sintered body, it is possible to effectively enhance the elongation characteristic after corrosion. Further, B is added as formation of CrB, so that the corrosion resistance and the elongation characteristic after corrosion can be further enhanced when the sintered body is used itself and is used as a part such as the sensor ring.

What is claimed is:

1. A corrosion resistant sintered body having excellent ductility, obtained by the process comprising the steps of: sintering a powder at a sintering temperature from not less than 1050° C. to less than 1300° C.;

wherein said powder comprising a ferrite stainless steel powder containing 11 to 22 wt % of Cr and a metal compound of B, the amount of B being from not less than 0.03 to less than 0.2 wt % based on the weight of said powder.

2. The corrosion resistant sintered body according to claim 1, wherein said powder comprising said ferrite stainless steel powders containing: $0<C\leqq0.1$ wt %; $0<Si\leqq3.0$ wt %; $0<Mn\leqq0.30$ wt %; $0<Ni\leqq2.0$ wt %; 11 wt % $\leqq Cr\leqq22$ wt %: $0<Mo\leqq3.0$ wt %; and the rest being substantially Fe.

3. The corrosion resistant sintered body according to claim 1, wherein said metal compound of B is Cr compound.

4. The corrosion resistant sintered body according to claim 3, wherein said metal compound is at least one of CrB, $CrB_2$, Fe—B, NiB.

5. The corrosion resistant sintered body according to claim 1, wherein said sintering temperature is in the range of 1150° C. to 1250° C.

6. The corrosion resistant sintered body according to claim 2, wherein said powder comprising said ferrite stainless steel powders containing: $0<C\leqq0.03$ wt %; $0<Si\leqq1.50$ wt %; $0<Mn\leqq0.30$ wt %; $0<Ni\leqq2.0$ wt %; 15.5 wt % $\leqq Cr\leqq18.5$ wt %: 0.01 wt % $<Mo\leqq3.0$ wt %; and the rest being substantially Fe.

7. The corrosion resistant sintered body according to claim 1, wherein the amount of B is in the range of 0.05 to 0.15 wt % based on the weight of said powder.

8. The corrosion resistant sintered body according to claim 6, wherein the amount of Mo is in the range of 0.8 to 2.1 wt %.

9. The corrosion resistant sintered body according to claim 1, wherein said powder contains not more than 1 wt % of Nb.

10. A corrosion resistant sintered body having excellent ductility obtaining by a process comprising the step of sintering a ferrite stainless steel powder containing 11 to 22% of Cr and metal compound of B, the amount of B being from not less than 0.03 to less than 0.2 wt % based on the weight of said powder;

wherein pores of said sintered body is rounded and the number of open pores is small.

11. The corrosion resistant sintered body according to claim 10, containing: $0<C\leqq0.1$ wt %; $0<Si\leqq3.0$ wt %; $0<Mn\leqq0.30$ wt %; $0<Ni\leqq2.0$ wt %; and $0<Mo\leqq3.0$ wt %.

12. The corrosion resistant sintered body according to claim 10, wherein said metal compound of B contains Cr.

13. The corrosion resistant sintered body according to claim 10, wherein the volume ratio of open pores which open to air to the whole of pores are not more than 20%.

14. The corrosion resistant sintered body according to claim 13, wherein the volume ratio of open pores which open to air to the whole of pores are not more than 14%.

15. The corrosion resistant sintered body according to claim 11, containing: $0<C\leqq0.03$ wt %; $0<Si\leqq1.50$ wt %; $0<Mn\leqq0.30$ wt %; $0<Ni\leqq2.0$ wt %; 15.5 wt % $\leqq Cr\leqq18.5$ wt %: 0.01 wt % $<Mo\leqq3.0$ wt%; and the rest being substantially Fe.

16. The corrosion resistant sintered body according to claim 10, wherein the amount of B is in the range of 0.05 to 0.15 wt % based on the weight of said body.

17. The corrosion resistant sintered body according to claim 15, wherein the amount of Mo is in the range of 0.8 to 2.1 wt %.

18. The corrosion resistant sintered body according to claim 10, contains not more than 1 wt % of Nb.

19. A sensor ring using the corrosion resistant body as claimed in any one of claims 1 to 18.

20. An engagement part using the corrosion resistant body as claimed in any one of claims 1 to 18.

* * * * *